US006417630B1

(12) United States Patent
Simpelaar

(10) Patent No.: US 6,417,630 B1
(45) Date of Patent: Jul. 9, 2002

(54) CIRCUIT ARRANGEMENT

(75) Inventor: Bennie I. P. Simpelaar, Terneuzen (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/568,929

(22) Filed: May 11, 2000

(30) Foreign Application Priority Data

May 19, 1999 (EP) ..... 99201579

(51) Int. Cl.[7] ..... G05F 1/00

(52) U.S. Cl. ..... 315/291; 315/224; 315/94; 315/106; 315/107

(58) Field of Search ..... 315/291, 307, 315/200 R, 224, 225, DIG. 7, 94, 105, 106, 107, 112, 116

(56) References Cited

U.S. PATENT DOCUMENTS 4,647,820 A * 3/1987 Chermin et al. ..... 315/245
4,772,819 A * 9/1988 Ridders ..... 313/493
4,935,672 A * 6/1990 Lammers et al. ..... 315/200 R
4,952,845 A * 8/1990 Veldman ..... 315/209 R
5,223,767 A * 6/1993 Kulka ..... 315/209 R
5,424,611 A 6/1995 Moriarty, Jr. ..... 315/94
6,084,361 A * 7/2000 Wacyk ..... 315/291

FOREIGN PATENT DOCUMENTS

EP 0566815 A1 10/1993 ..... H05B/41/29
WO WO9312631 6/1993 ..... H05B/41/29

* cited by examiner

*Primary Examiner*—Don Wong
*Assistant Examiner*—Tuyet T. Vo

(57) ABSTRACT

A ballast circuit for operating a lamp having preheatable electrodes. The frequency of a high frequency bridge inverter is controlled by a control circuit which has input connections to one of the lamp electrodes for monitoring the electrode temperature. The voltage across the lamp electrode controls oscillation frequency during preheating and ignition.

8 Claims, 3 Drawing Sheets

CIRCUIT ARRANGEMENT

BACKGROUND OF THE INVENTION

The invention relates to a circuit arrangement for feeding a discharge lamp, comprising

- input terminals for the connection to a supply voltage source,
- switching means coupled to the input terminals for generating a high-frequency current from a supply voltage supplied by the supply voltage source,
- a control circuit coupled to the switching means for rendering the switching means high-frequency conducting and non-conducting,
- a temperature-dependent impedance for preheating electrodes of the discharge lamp.

The invention also relates to a compact lamp.

A circuit arrangement as mentioned in the opening paragraph is known from U.S. Pat. No. 4,935,672. In the known circuit arrangement, the switching means form part of an inverter of the half-bridge type. A load branch, which during operation contains the lamp, is coupled to this half bridge. The temperature-dependent impedance is formed by a PTC, which shunts the lamp and is connected in series with the electrodes of the lamp. When the circuit arrangement is in operation, the switching means generate a high-frequency current through the load branch. Immediately after the circuit has been put into operation, the temperature of the PTC is relatively low. As a result, also the impedance of the PTC is relatively low. This causes a current with a relatively high amplitude to flow through the electrodes of the lamp, and the voltage across the lamp, which is equal to the voltage across the PTC, to be relatively low. In this stage of operation of the lamp, the electrodes of the lamp are preheated. Since the PTC carries a current, the temperature of the PTC increases and hence also the impedance of the PTC. As the impedance of the PTC increases, the amplitude of the current through the electrodes decreases, and the amplitude of the voltage across the lamp increases to a value at which the lamp ignites. The presence of the PTC in the known circuit arrangement thus causes the electrodes of the lamp to be preheated before the lamp is ignited. A drawback of the known circuit arrangement resides in that the PTC is a relatively expensive component which must be added to the circuit arrangement for preheating the electrodes. In addition, the PTC also carries a current during normal operation of the lamp, so that a certain amount of power is dissipated in the PTC.

BRIEF SUMMARY OF THE INVENTION

It is an object of the invention to provide a circuit arrangement for feeding a lamp, which circuit arrangement can also be used to heat the electrodes of the lamp before the lamp is ignited, which circuit arrangement is, in addition, relatively inexpensive and has a relatively high efficacy.

To achieve this, a circuit arrangement of the type mentioned in the opening paragraph is characterized in accordance with the invention in that the temperature-dependent impedance comprises, during operation of the lamp, one of the electrodes of the lamp and forms part of the control circuit.

As the temperature-dependent impedance comprises an electrode of the lamp, the circuit arrangement is relatively inexpensive. In addition, the load branch of the circuit arrangement does not comprise components which, during normal operation, do not fulfill a function but do dissipate power. As a result, the efficiency of a circuit arrangement in accordance with the invention is relatively high.

Good results have been obtained with embodiments of a circuit arrangement in accordance with the invention, wherein the switching means comprise a series arrangement of two switching elements.

A circuit arrangement in accordance with the invention can very suitably be used in the electronic ballast of a compact lamp comprising

- a light source provided with a gastight lamp vessel which allows passage of visible light,
- a housing which is secured to the light source and provided with a lamp cap,
- an electronic ballast which is electrically connected to the light source in order to feed the light source, which electronic ballast is situated in a space which is surrounded by the housing.

These and other aspects of the invention will be apparent from and elucidated with reference to the embodiments described hereinafter.

DETAILED DESCRIPTION OF THE INVENTION

Figure 1:
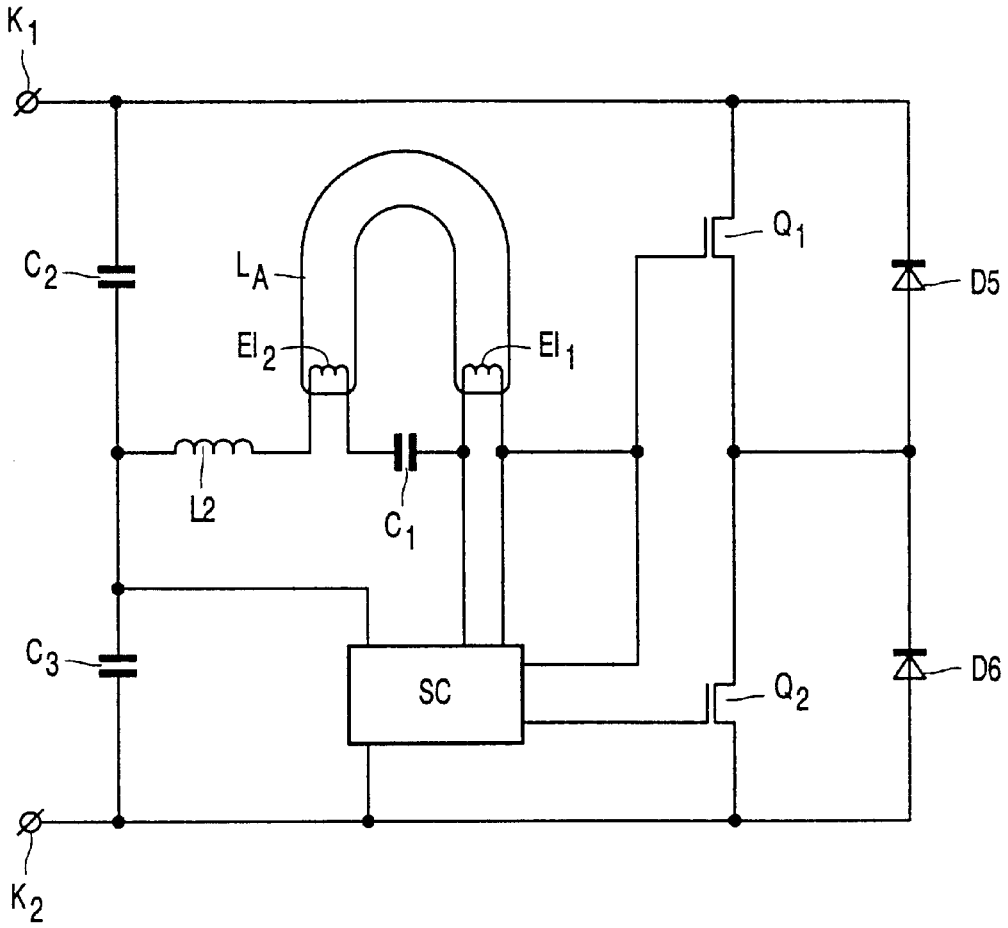
FIG. 1 and FIG. 2 show examples of a circuit arrangement in accordance with the invention to which a lamp is connected.

In FIG. 1, K1 and K2 are input terminals which are to be connected to a supply voltage source. The example shown in FIG. 1 can suitably be fed by means of a direct voltage source. Input terminals K1 and K2 are interconnected by means of a series arrangement of a first switching element Q1 and a second switching element Q2, which, in this example, form switching means for generating a high-frequency current from a supply voltage supplied by the supply voltage source. The first switching element Q1 is shunted by a diode D5 and the second switching element Q2 is shunted by a diode D6. Control electrodes of the first switching element Q1 and the second switching element Q2 are connected to respective outputs of a circuit part SC. Input terminals K1 and K2 are also interconnected by means of a series arrangement of a capacitor C2 and a capacitor C3. A common point of capacitor C2 and capacitor C3 is connected to a common point of the first switching element Q1 and the second switching element Q2 by means of a series arrangement of a first lamp electrode E11 of lamp La, capacitor C1, a second lamp electrode E12 of lamp La and a coil L2. This series arrangement forms a load branch. The first lamp electrode E11 forms, in this example, a temperature-dependent impedance. Respective ends of the first lamp electrode E11 are connected to, respectively, a first and a second input of the circuit part SC. In this example, the circuit part SC and the first lamp electrode E11 jointly form a control circuit for rendering the switching means high-frequency conducting and non-conducting. Respective ends of capacitor C3 are connected to, respectively, a third and a fourth input of the circuit part SC.

The operation of the circuit arrangement shown in FIG. 1 is as follows.

If the input terminals K1 and K2 are connected to the poles of a supply voltage source, the circuit part SC renders the switching elements Q1 and Q2 alternately high-frequency conducting and non-conducting with a frequency f. As a result, a high-frequency alternating current, also with a frequency f, flows in the load branch. Immediately after the circuit arrangement has been put into operation, the temperature of lamp electrode E11 is low. As a result, the impedance of lamp electrode E11 is low and the voltage across lamp electrode E11 has a relatively small amplitude. This voltage is present between the first and the second input of circuit part SC. If the amplitude of the voltage across the first lamp electrode E11 is relatively low, the circuit part SC sets the frequency f with which the switching elements are rendered conducting and non-conducting to a relatively high value. Since the value of f is relatively high, the voltage across capacitor C1 has a relatively small amplitude, so that the lamp La does not ignite at the voltage across capacitor C1. As the time during which the current flows in the load branch increases, however, the temperature of the lamp electrode E11 increases too. As a result, both the impedance of lamp electrode E11 and the amplitude of the voltage across lamp electrode E11 increase. As a result of the higher amplitude of the voltage between the first and the second input of the circuit part SC, the circuit part SC sets the frequency f to a lower value. This decrease of the frequency f causes the amplitude of the voltage across capacitor C1 to increase. When the temperature of lamp electrode E11 has increased to a value suitable for emission, also the amplitude of the voltage across capacitor C1 has increased to such a level that the lamp ignites at this voltage. It is thus achieved that the lamp does not ignite until after the lamp electrodes are sufficiently preheated. During stationary operation of the lamp, the temperature of the lamp electrode E11 remains approximately constant, so that the same applies to the frequency f.

Figure 2:
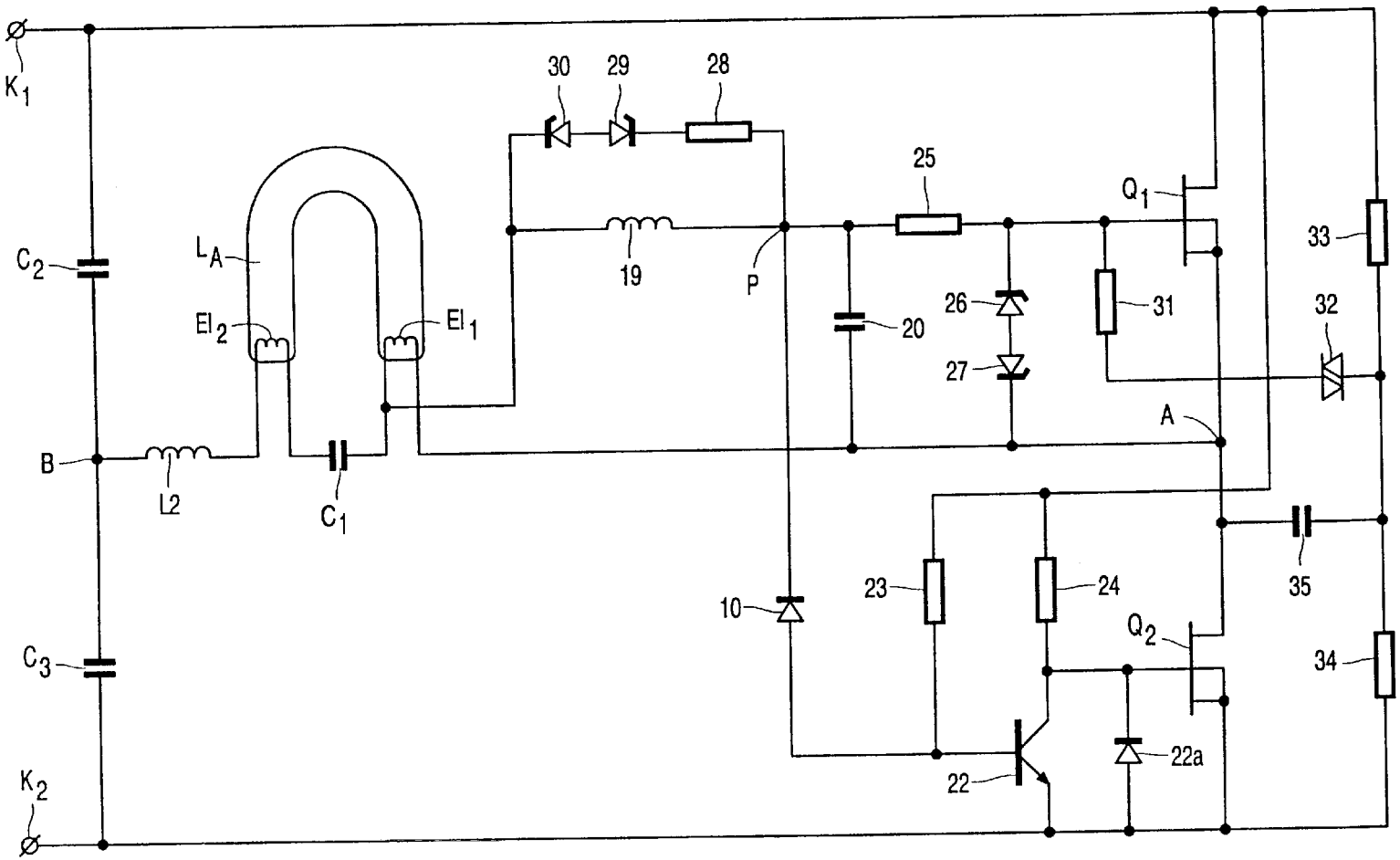

In the example shown in FIG. 2, components and circuit parts which correspond to components and circuit parts of the example shown in FIG. 1 bear the same reference numerals.

K1 and K2 are input terminals to be connected to a supply voltage source. Also the example shown in FIG. 2 can suitably be fed by means of a direct voltage source. Input terminals K1 and K2 are interconnected by means of a series arrangement of a first switching element Q1 and a second switching element Q2. Input terminals K1 and K2 are also interconnected by means of a series arrangement of capacitor C2 and capacitor C3 and by means of a series arrangement of ohmic resistance 33 and ohmic resistance 34. A common point B of capacitor C2 and capacitor C3 is connected to a common point A of the first switching element Q1 and the second switching element Q2 by means of a load branch, which is formed by a series arrangement of the first lamp electrode E11 of lamp La, capacitor C1, second lamp electrode E12 of lamp La and coil L2. Also in this example, electrode E11 forms a temperature-dependent impedance. The first lamp electrode E11 is shunted by a series arrangement of a coil 19 and a capacitor 20. Coil 19 is shunted by a series arrangement of zener diodes 30 and 29 and ohmic resistance 28. Capacitor 20 is shunted by a series arrangement of zener diodes 26 and 27 and ohmic resistance 25. A common point of zener diode 26 and ohmic resistance 25 is connected to a control electrode of the first switching element Q1. A common point P of coil 19 and capacitor 20 is connected to a cathode of diode 10. An anode of diode 10 is connected to a base electrode of bipolar transistor 22. An emitter electrode of bipolar transistor 22 is connected to input terminal K2. The base electrode of bipolar transistor 22 is connected to input terminal K1 via ohmic resistance 23. A collector electrode of bipolar transistor 22 is also connected to input terminal K1 by means of ohmic resistance 24. The collector electrode of bipolar transistor 22 is directly connected to a control electrode of the second switching element Q2. By means of diode 22*a*, input terminal K2 is also connected to the control electrode of the second switching element Q2. The common point A of the first switching element Q1 and the second switching element Q2 is connected, via capacitor 35, to a common point of ohmic resistance 33 and ohmic resistance 34. The common point of ohmic resistance 33 and ohmic resistance 34 is also connected to the control electrode of the first switching element Q1 by means of a series arrangement of a breakdown element 32 and ohmic resistance 31. The control voltages with which the first and the second switching element are rendered conducting and non-conducting are derived, in this example, from the voltage across the first lamp electrode E11. In this example, the first lamp electrode E11, zener diodes 26, 27, 29, 30, coil 19, capacitor 20, ohmic resistances 23, 24 and 25, bipolar transistor 22 and diodes 10 and 22a jointly form a control circuit for rendering the switching means high-frequency conducting and non-conducting. Ohmic resistances 31, 33 and 34 and breakdown element 32 and capacitor 35 jointly form a starter circuit to start the oscillation in the circuit arrangement immediately after a supply voltage source has been connected. The operation of the starter circuit corresponds to the operation of the starter circuit of the circuit arrangement shown in FIG. 2 of U.S. Pat. No. 4,935,672. The operation of the control circuit also corresponds to that of the control circuit of the circuit arrangement shown in FIG. 2 of U.S. Pat. No. 4,935,672. The only difference resides in that the circuit arrangement shown in U.S. Pat. No. 4,935,672 uses a part of the ballast coil instead of the first lamp electrode to generate control voltages for the first and the second switching element. For more detailed information about the operation of the starter circuit and the control circuit reference is made to U.S. Pat. No. 4,935,672.

The operation of the example shown in FIG. 2 is as follows.

If a direct voltage source is connected to input terminals K1 and K2, the starter circuit causes the circuit arrangement to start oscillating, and the control circuit renders the first and the second switching element alternately high-frequency conducting and non-conducting with a frequency f. As a result, an alternating current with a frequency f flows in the load branch. Immediately after the circuit arrangement has been put into operation, the temperature of the first lamp electrode E11 is relatively low. As a result, the impedance of the first lamp electrode is relatively low and the amplitude of the voltage across the first lamp electrode is also relatively low. Due to this low amplitude of the voltage across the first lamp electrode, the frequency f has a relatively high value and the amplitude of the voltage across capacitor C1 is relatively low. The temperature of the first lamp electrode increases as the time during which current flows through the first lamp electrode is longer. As a result, also the impedance of the first lamp electrode E11 and the amplitude of the voltage across the first lamp electrode E11 increase. This causes the value of the frequency f to decrease and the amplitude of the voltage across capacitor C1 to increase. When the temperature of lamp electrode E11 has increased to a suitable value for emission, also the amplitude of the voltage across capacitor C1 has increased to such a level that the lamp ignites at this voltage. It is thus achieved that the lamp does not ignite until after the lamp electrodes are preheated sufficiently. During stationary operation of the lamp, the temperature of lamp electrode E11 remains approximately constant, so that the same applies to the frequency f.

Figure 3:
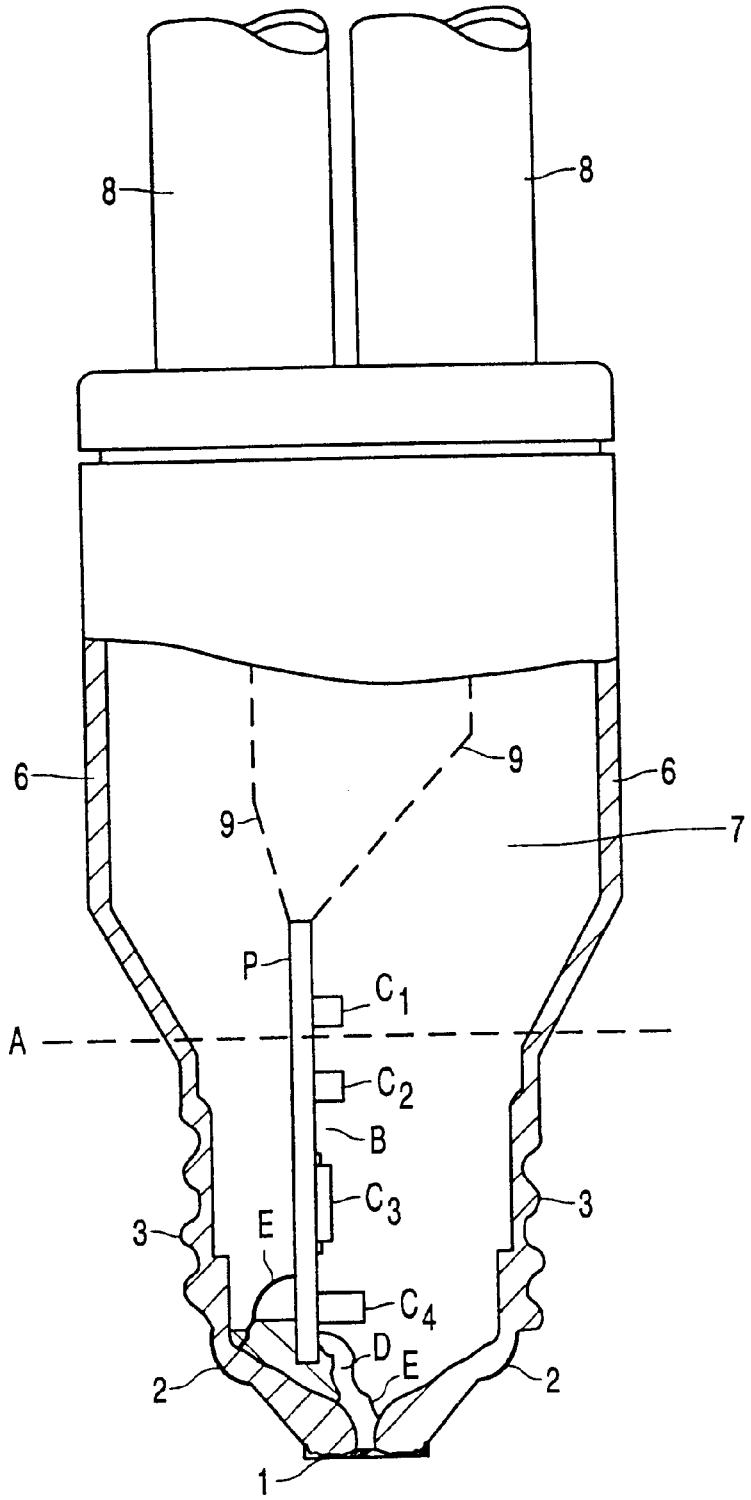
FIG. 3 shows an example of a compact lamp in accordance with the invention.

In FIG. 3, reference numeral 8 refers to a part of a gastight lamp vessel which passes visible light. Reference numeral 6 refers to the wall of a housing connected to the lamp vessel 8 and provided with a lamp cap 3, a circuit arrangement B in accordance with the invention being present in a space 7 surrounded by the housing. The circuit arrangement is diagrammatically represented by the components P and C1–C4. Reference numeral 9 refers to electric connections between the circuit arrangement and (not shown) electrodes in the lamp vessel. E refers to connection wires between the circuit arrangement and electric contacts 1 and 2 arranged on the lamp cap.

What is claimed is:

1. A circuit arrangement for feeding a discharge lamp having preheatable electrodes, comprising:

input terminals for connection to a supply voltage source, switching means coupled to the input terminals for generating a high-frequency current from a supply voltage supplied by the supply voltage source, a single control means coupled to the switching means for rendering the switching means conducting and non-conducting at a high frequency, and temperature-dependent means for preheating the electrodes of the discharge lamp, characterized in that the temperature-dependent means forms part of the single control means, and comprises input connections for a control circuit, said input connections being connected to one of the electrodes of the lamp.

2. An arrangement as claimed in claim 1, wherein the switching means comprises a series arrangement of two switching elements.

3. An arrangement as claimed in claim 1, wherein said one of said electrodes has two ends, and said input connections consist of a first connection to one of said ends, and a second connection to the other of said ends.

4. An arrangement as claimed in claim 3, characterized in that during preheat and ignition said input connections sense voltage across said one of the electrodes, and control said high frequency responsive to the sensed voltage.

5. A compact lamp comprising:

a light source having preheatable electrodes in a gastight lamp vessel which allows passage of visible light, a housing comprising a lamp cap, said housing being secured to the lamp vessel, and an electronic ballast which is electrically connected to the light source to feed the light source, said electronic ballast being situated in a space surrounded by said housing, wherein said electronic ballast comprises:

input terminals for connection to a supply voltage source, switching means coupled to the input terminals for generating a high-frequency current from a supply voltage supplied by the supply voltage source, control means coupled to the switching means for rendering the switching means conducting and non-conducting at a high frequency, and temperature-dependent means for preheating the electrodes of the discharge lamp, characterized in that the temperature-dependent means forms part of the control means, and comprises input connections for a control circuit, said input connections being connected to one of the electrodes of the light source.

6. A lamp as claimed in claim 5, wherein the switching means comprises a series arrangement of two switching elements.

7. A lamp as claimed in claim 5, wherein said one of said electrodes has two ends, and said input connections consist of a first connection to one of said ends, and a second connection to the other of said ends.

8. A lamp as claimed in claim 7, characterized in that during preheat and ignition said input connections sense voltage across said one of the electrodes, and control said high frequency responsive to the sensed voltage.

* * * * *